United States Patent [19]

Theurer et al.

[11] Patent Number: 4,773,332

[45] Date of Patent: Sep. 27, 1988

[54] MOBILE APPARATUS FOR LOADING, TRANSPORTING AND LAYING AN ASSEMBLED TRACK SECTION

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 36,068

[22] Filed: Apr. 9, 1987

[30] Foreign Application Priority Data

Apr. 18, 1986 [AT] Austria ..... 1036/86

[51] Int. Cl.[4] ..... E01B 29/02

[52] U.S. Cl. ..... 104/3; 105/215.1; 280/763.1

[58] Field of Search ..... 104/2, 3, 5, 243, 306, 104/9, 7.2; 105/165, 171, 215.1; 414/339; 180/8.1, 8.5, 9.46, 9.44; 280/86, 113, 763.1, 766.1

[56] References Cited

U.S. PATENT DOCUMENTS

| | | | |
|---|---|---|---|
| 4,249,467 | 2/1981 | Theurer et al. | 104/3 |
| 4,261,264 | 4/1981 | Theurer et al. | 104/2 X |
| 4,270,456 | 6/1981 | Theurer et al. | 104/3 |
| 4,387,814 | 6/1983 | Beduhn et al. | 180/9.46 X |
| 4,516,503 | 5/1985 | Boccaletti | 104/3 |
| 4,566,389 | 1/1986 | Theurer et al. | 104/3 |

FOREIGN PATENT DOCUMENTS

| | | | |
|---|---|---|---|
| 329220 | 12/1931 | Fed. Rep. of Germany | 180/9.44 |
| 1759863 | 8/1971 | Fed. Rep. of Germany . | |
| 2432326 | 12/1975 | Fed. Rep. of Germany . | |
| 3340739 | 5/1984 | Fed. Rep. of Germany . | |
| 2104133 | 3/1983 | United Kingdom . | |

*Primary Examiner*—Robert B. Reeves
*Assistant Examiner*—Soctt H. Werny
*Attorney, Agent, or Firm*—Kurt Kelman

[57] ABSTRACT

A mobile apparatus for loading, transporting and laying an assembled track section comprises a self-propelled main vehicle comprising an elongated carrier frame, a pair of transversely aligned flanged wheels at each end thereof for engagement with, and support on, the rails of the assembled track section, a pair of lifting jacks at each carrier frame end associated with the flanged wheels, and a device for gripping the track section rails associated with each flanged wheel and associated lifting jack, the lifting jack being placeable on the track bed and operable to lift the carrier frame and flanged wheels with the assembled track section gripped by the rail gripping devices off the track bed, and an auxiliary self-propelled vehicle movable independently of the main vehicle and comprising a flatbed frame capable of receiving and supporting the carrier frame and flanged wheels of the main vehicle with the assembled track section gripped by the rail gripping devices, a track-bound undercarriage with flanged wheels and another, off-track undercarriage at each end of the flatbed frame, at least one of the undercarriages at each frame end being retractable, and an independent drive for each one of the undercarriages.

12 Claims, 2 Drawing Sheets

Figure 1:
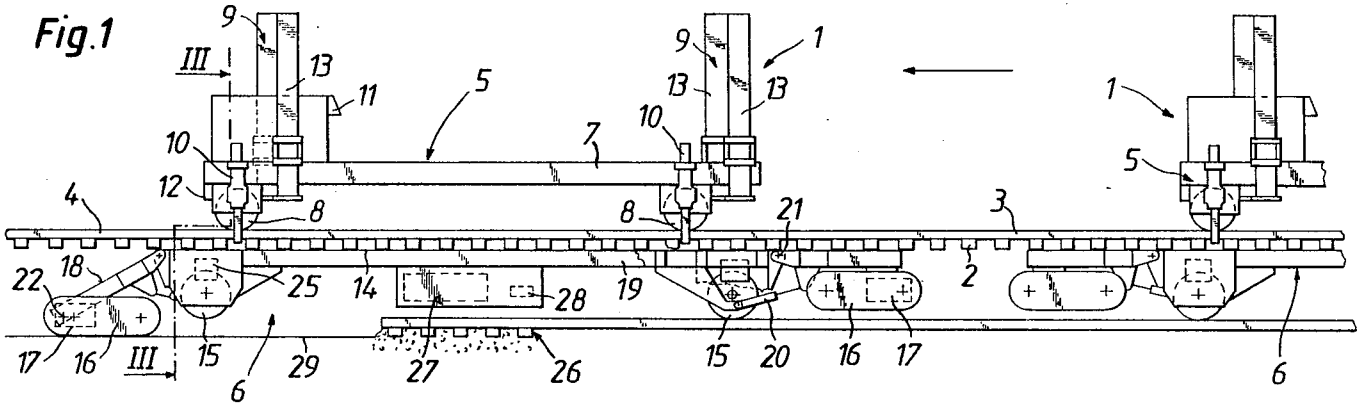

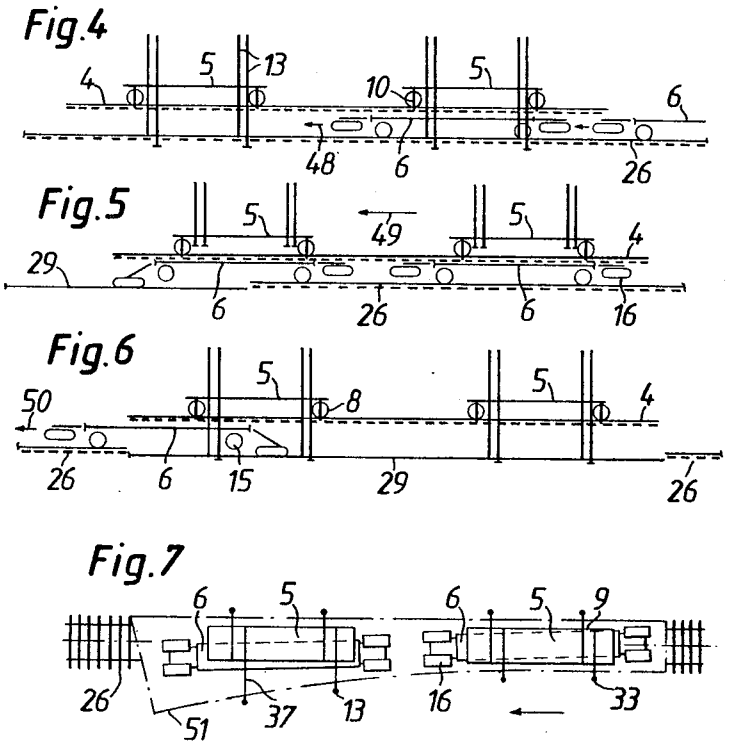
Fig.4
Fig.5
Fig.6
Fig.7
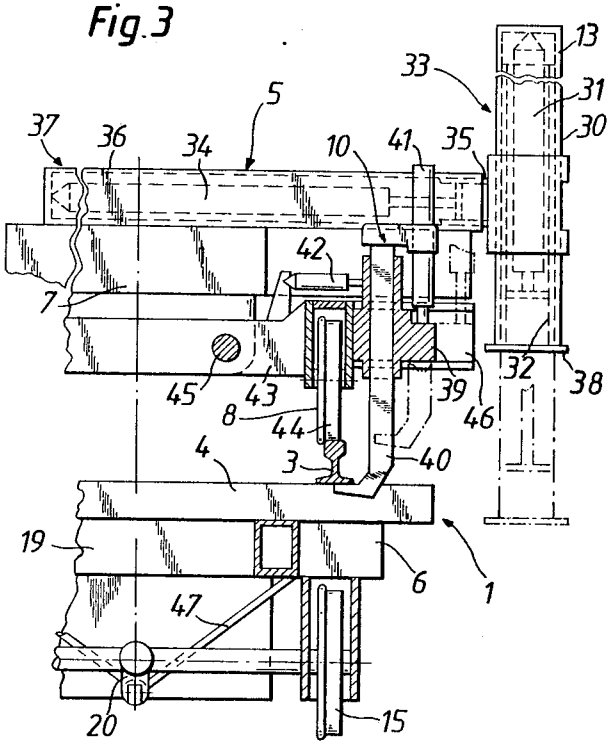
Fig.3

MOBILE APPARATUS FOR LOADING, TRANSPORTING AND LAYING AN ASSEMBLED TRACK SECTION

The present invention relates to a mobile apparatus for loading, transporting and laying an assembled track section consisting of rails fastened to ties on a track bed.

German patent application No. 2,432,326, published Dec. 4, 1975, discloses such an apparatus for handling track switch sections, which comprises a succession of carrier vehicles having a very short wheelbase and comprising pairs of transversely aligned flanged wheels at each end thereof for engagement with, and support on, the rails of the assembled track section, and a pair of lifting jacks and rail gripping means centered between the pairs of flanged wheels, and a succession of auxiliary vehicles consisting essentially of double-axled track-bound undercarriages capable of receiving and supporting the carrier vehicles and their flanged wheels with the assembled track section gripped by the rail gripping means. Adjacent carrier vehicles and auxiliary vehicles are connected by respective rods to form a train of auxiliary vehicles pulled on the railroad track by a tractor and a train of carrier vehicles supported on the auxiliary vehicles with respective track sections carried thereon. This apparatus has serious shortcomings, particularly in the handling of heavy switches. In view of the short wheelbase of the carrier vehicles and the provision of a single pair of lifting jacks at the center of the carrier vehicles, the carrier vehicles are very unstable when the lifting jacks are operated to lift the vehicle with the gripped track section off the track bed. During lifting, the assembly is supported only at two points and its stability depends essentially on the rigidity of the assembled track section. If the track section bends at one of its ends, for example, the entire assembly may tip over. The coupling rods between the vehicles cannot increase the stability since they merely serve to transmit pulling forces between the successive vehicles. The auxiliary vehicles are subject to a similar lack of stability since they essentially consist of undercarriages. In addition, the operation of the apparatus requires auxiliary track rails for the support of the auxiliary vehicles.

German patent application No. 1,759,863, published Aug. 19, 1971, also discloses a mobile apparatus for loading, transporting and laying an assembled track section consisting of rails fastened to ties on a track bed. It comprises a succession of independent track-bound main vehicles and track-bound auxiliary vehicles. Each main vehicle has a short carrier frame extending transversely across the track, a pair of flanged wheels and rail gripping means, as well as a pair of transversely aligned lifting jacks placeable on the track bed and operable to lift the carrier frame and flanged wheels with the assembled track section gripped by the rail gripping means off the track. The auxiliary vehicles have undercarriages with flanged wheels for movement along the railroad track and a flatbed frame on which the main vehicles carrying the track section may be loaded. To transport an assembled track section, the track section is placed on a railroad track and a plurality of the main vehicles are moved onto the track section and substantially equidistantly spaced from each other. The rail gripping means on the main vehicles are then operated to grip the track section and the lifting jacks are placed on the track bed and operated to lift the track section with the main vehicles off the track bed. The auxiliary vehicles are then moved on the railroad track under the lifted track section and the lifting jacks are operated to lower the assembly onto the flatbed frames of the auxiliary vehicles. The entire mobile apparatus is then moved over an auxiliary track to a track renewal section where the assembled track section is laid on the track bed after the auxiliary track and the auxiliary vehicles have been removed. The operation of the many independent vehicles as well as the placement and removal of an auxiliary track is very time-consuming, is accident- and trouble-prone, due to the numerous manipulations involved, and the short main carrier vehicles are unstable.

Another such mobile apparatus is known from UK patent application No. 2,104,133 A, published Mar. 2, 1983. It comprises two vertically adjustable gantry cranes running on an auxiliary track and interconnected by a girder extending in the direction of the track. The gage of the auxiliary track and corresponding width of the gantry cranes considerably exceeds the length of the track ties, thus producing a very wide apparatus which cannot be installed if there are obstacles on the track shoulders and also is difficult to assemble and disassemble.

The mobile track section handling apparatus disclosed in German patent application No. 3,340,739, published May 30, 1984, comprises a bridge-like carrier having a length exceeding the length of the assembled track section. At its opposite ends, the carrier has a track-bound undercarriage as well as vertically and laterally adjustable track-laying undercarriages at both sides thereof whereby the carrier may be selectively supported on the railroad track or on the track bed. A succession of hoists with lifting hooks are arranged along the length of the carrier. For laying an assembled track section, it is placed on a flatbed car and moved on the track to a point immediately adjacent the trackless renewal section on which the assembled track section is to be laid. The bridge-like carrier is then moved on the track-laying undercarriages from the trackless renewal section over the flatbed car carrying the assembled track section, the track-laying undercarriages moving over the ends of the ties of the track on which the flatbed car stands. The hoists are then operated to grip and lift the assembled track section of the flatbed car, and the bridge-like carrier is then returned to the trackless renewal section on the track-laying undercarriages. After the bridge-like carrier has been so centered over the trackless renewal section that its track-bound undercarriages are positioned above the respective ends of the railroad track adjacent the trackless renewal section, the track-laying undercarriages are retracted so that the track-bound undercarriages support the bridge-like carrier on the railroad track ends, and the hoists are operated to lower the track section onto the trackless renewal section. The very long bridge-like carrier makes such an apparatus very heavy and difficult to operate. In addition, the track-laying undercarriages running on the tie ends of the existing track subject this track section to undesirable loads tending to damage the same.

A similar apparatus is disclosed in U.S. Pat. No. 4,269,467, dated Feb. 10, 1981. The elongated bridge-like carrier of this apparatus is supported at each end by two track-bound undercarriages and a track-laying undercarriage mounted therebetween and pivotal about a vertical axis. A hoist is mounted on the carrier between the undercarriages for gripping and transporting an assembled track section. This apparatus is very robust and stable. It may also be used for hoisting track sections placed on the shoulder of the track because the carrier may be moved laterally on the track-laying undercarriages upon pivoting the same through 90°. The three different undercarriages at each end of the carrier provide particular advantages in moving the apparatus into and out of the trackless renewal section. However, the apparatus is also very heavy and somewhat cumbersome to operate.

U.S. Pat. No. 4,270,456 comprises a track-bound transport vehicle, an elongated overhead girder extending above the vehicle and gantry supports for supporting the girder vertically adjustably on the track bed. The overhead girder projects from an end of the vehicle and has a guide track for a trolley with vertically adjustable hoisting means. This rather complex apparatus is designed for handling very heavy and wide track sections.

It is the primary object of the invention to improve known mobile apparatus for handling assembled track sections so that even the heaviest track sections may be efficiently hoisted and transported under very stable conditions and without the need for auxiliary tracks.

The above and other objects are accomplished according to the present invention with a mobile apparatus for loading, transporting and laying an assembled track section consisting of rails fastened to ties on a track bed, which comprises (a) a self-propelled main vehicle comprising an elongated carrier frame having two opposite ends, a pair of transversely aligned flanged wheels at each end of the elongated carrier frame for engagement with, and support on, the rails of the assembled track section, a pair of lifting jacks at each carrier frame end, a respective one of the lifting jacks being associated with a respective one of the flanged wheels, and a respective device mounted on the elongated carrier frame for gripping the track section rails associated with each flanged wheel and associated lifting jack, the lifting jacks being placeable on the track bed and operable to lift the carrier frame and flanged wheels with the assembled track section gripped by the rail gripping devices off the track bed, and (b) an auxiliary self-propelled vehicle movable independently of the main vehicle and comprising a flatbed frame having two opposite ends and capable of receiving and supporting the carrier frame and flanged wheels of the main vehicle with the assembled track section gripped by the rail gripping devices, a track-bound undercarriage with flanged wheels and another, off-track undercarriage at each end of the flatbed frame, at least one of the undercarriages at each frame end being retractable, and an independent drive for each one of the undercarriages.

Such an apparatus enables even the heaviest assembled track sections to be hoisted while the main vehicle remains stable and without subjecting the rail fasteners to undue stresses. The transport of the track sections is also very efficiently handled because the auxiliary vehicles are readily movable not only on the track but also in the trackless renewal section. The high stability of the main vehicle carrying the track section is assured by the considerable distance between the pairs of lifting jacks at the ends of the elongated main vehicle carrier frame, providing a four-point support during hoisting. This rigid, bridge-like construction and the four-point grip on the track section enables very high stresses and weights to be transferred essentially torsion-free through the lifting jacks from the assembled track section to the track bed. In addition, the four lifting jacks supporting the main vehicle and the gripped track section on the track bed can support the assembly very stably even when asymmetrical track switches are handled, which exert uneven stresses. The selective use of the track-bound and off-track undercarriages enables the auxiliary vehicles with the main vehicles carrying the track section to be readily moved into and out of the trackless renewal section from and to the track without the time- and labor-consuming laying of auxiliary tracks.

Figure 2:
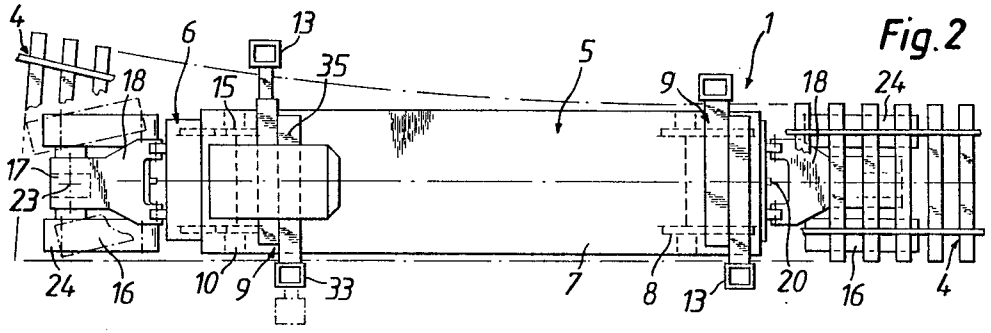

The above and other objects, advantages and features of this invention will become more apparent from the following detailed description of certain now preferred embodiments thereof, taken in conjunction with the accompanying, generally schematic drawing wherein:

FIG. 1 is a side elevational view of a mobile apparatus comprising two successively arranged auxiliary vehicles and main vehicles spaced to carry a switch track section having an approximate length of about 35 m, FIG. 2 is a top view of the front auxiliary vehicle and main vehicle of the apparatus of FIG. 1, FIG. 3 is an enlarged sectional view along line III—III of FIG. 1, FIGS. 4 to 6 diagrammatically illustrate different operating positions of two cooperating main vehicles and an auxiliary vehicle in handling a somewhat shorter, for example about 26 m long, track switch, and FIG. 7 is a similarly diagrammatic top view of the mobile apparatus ready to lay a track switch in a trackless renewal section.

Referring now to the drawing and first to FIGS. 1 and 2, there is shown mobile apparatus 1 for loading, transporting and laying assembled switch track section 4 consisting of rails 3 fastened to ties 2 on a track bed in a trackless renewal section. The apparatus comprises self-propelled main vehicle 5 and auxiliary self-propelled vehicle 6, two successive ones of such associated vehicles being shown in FIG. 1 for handling a long track section. The main vehicle comprises elongated carrier frame 7 having two opposite ends. A pair of transversely aligned flanged wheels 8 and a pair 9 of lifting jacks 13 are arranged at each carrier frame end, the flanged wheels engaging rails 3 of assembled track section 4 and supporting elongated carrier frame 7 thereon. Respective device 10 for gripping track section rails 4 is mounted on the elongated carrier frame and associated with each flanged wheel 8 and associated lifting jack 13. The lifting jacks are placeable on the track bed and operable to lift carrier frame 7 and flanged wheels 8 with assembled track section 4 gripped by rail gripping devices 10 off the track bed. Main vehicle 5 is equipped with drive 12 which makes the vehicle self-propelled. The main vehicle also has a control panel 11 and a common power plant for operating the drive and the jacks. As best shown in FIG. 2, each pair 9 of lifting jacks is comprised of two lifting jacks 13 arranged at opposite sides of elongated carrier frame 5 and staggered from each other in the direction of the track. The elongated carrier frame is configurated for the transport of assembled track sections of different lengths and has a length of at least about 3 m and not exceeding about 15 m to enable track sections with about 5 to 25 ties of a standard spacing of about 60 cm to be gripped thereto. Such carrier frame dimensions assure sufficient stability to prevent tipping of the main vehicle during operation of the lifting jacks and uniform gripping of the track section during transport, and they provide a carrier vehicle which is not too long and heavy.

Auxiliary vehicle 6 comprises flatbed frame 19 having two opposite ends and loading platform 14 capable of receiving and supporting carrier frame 7 and flanged wheels 8 of main vehicle 5 with assembled track section 4 gripped by rail gripping devices 10, as shown in FIG. 1. Track-bound undercarriage 15 with flanged wheels and another, off-track undercarriage 16 are arranged at each end of flatbed frame 19, at least one of the undercarriages at each end being retractable. Each undercarriage 15 has independent drive 25 to propel the auxiliary vehicle on track 26 and each undercarriage 16 has independent drive 17 whereby auxiliary vehicle 6 is self-propelled off track. Centrally suspended from flatbed frame 19 between the opposite ends thereof are central power plant 27 and control arrangement 28 for operation of the auxiliary vehicle.

In the illustrated embodiment, off-track undercarriages 16 are track-laying undercarriages. Brackets 18 carry track-laying undercarriages 16, the brackets projecting from the flatbed frame ends and being pivoted thereto. Hydraulically operated pivoting drive 20 is connected to each track-laying undercarriage for pivoting the same about horizontal axis 21 extending transversely to the flatbed frame for moving the track-laying undercarriages between an operating position (shown on the left side of FIG. 1) and a retracted rest position (shown on the right side of FIG. 1). Brackets 18 are configurated to constitute substantially horizontal extensions of the flatbed frame in the retracted rest position. As shown in FIG. 2, each track-laying undercarriage 16 has two track-laying chains 24 transversely spaced apart a distance corresponding substantially to the transverse spacing (gauge) of rails 4, and substantially vertical steering axle 23 is centered between the track-laying chains and rotatably connects the track-laying undercarriages to pivotal brackets 18.

The projection of the track-laying undercarriages from the opposite ends of the flatbed frame enables the auxiliary carriage to be moved smoothly and without problems into and from renewal section 29, pivoting of bracket 18 enabling the projecting undercarriage to be lowered onto the trackless renewal section while the auxiliary vehicle is still supported on the track by track-bound undercarriages 15. The pivotal carrying bracket also provides a simple and robust retractable support for the track-laying undercarriage while keeping the flatbed frame low. By so constructing the supporting bracket that it forms an extension of the flatbed frame in its retracted rest position, an additional support surface is provided for the assembled track section during transport. It also enables the flatbed frame to be kept very low since, in effect, a portion of this frame is used for the pivotal connection of the track-laying undercarriage without the interposition of an auxiliary support frame. The pivotal mounting of the track-laying undercarriage about horizontal and vertical axes imparts high movability thereto and enables the undercarriage to be steered in track curves as well as in desired directions in trackless renewal section 29. The use of the two transversely spaced track-laying chains provides a much stabler four-point support for the track-laying undercarriages of the auxiliary vehicle than would be provided by a single, wide track-laying chain, which assures a safe transport even for asymmetrical track switches. The arrangement of the pivotal carrying bracket between the two track-laying chains provides a further lowering of the flatbed frame.

As shown in FIG. 1, two like mobile apparatuses 1 are arranged successively for the transport of long (35 m) track sections, each apparatus 1 carrying half of the track section.

As best shown in FIG. 3, a transverse displacement jack 35 is connected to each lifting jack for transversely positioning the lifting jack with respect to elongated carrier frame 7. The transverse displacement jacks in a retracted position have a length corresponding at least to the length of ties 2 and comprise power, i.e. hydraulic, drives 34 for extending them by about a tie length for transverse displacement of the lifting jacks. This dimensioning assures sufficient displacement to the left and the right of the elongated carrier frame while placing the lifting jacks immediately adjacent the ends of ties 2 in their retracted position. Each transverse displacement jack comprises guiding sleeve 36 of polygonal, i.e. rectangular, cross section affixed to elongated carrier frame 7 and telescopingly housing a transversely movable jack member. Each lifting jack includes vertically extending guiding sleeve 30 of polygonal, i.e. rectangular, cross section telescopingly housing longitudinally displaceable inner sleeve 32 of like cross section, each transversely movable jack member being connected to a respective guiding sleeve 30 of the lifting jacks. The lower free ends of inner sleeves 32 carry horizontally extending support shoe 38 for better support of the lifting jacks on the track bed.

The transverse displaceability of each lifting jack substantially facilitates the transport of asymmetrical track sections, such as track switches, since this enables each lifting jack to be positioned in conformity with the circumferential configuration of the track section and thus avoids any danger of tipping over. Furthermore, it enables the lifting jacks to be slightly moved laterally to avoid any local unevenness of the track bed so that a secure support is assured. The telescoping arrangement of the displacement and lifting jacks is not only simple and robust but assures a good transfer of moving forces so that even the heaviest track sections may be handled.

Preferred rail gripping device 10, as illustrated in FIG. 3, comprises a respective flanged wheel 8 of the main vehicle and gripping hook 40 vertically adjustably mounted on elongated carrier frame 7 and facing the respective flanged wheel for selectively engaging a base or head of rail 3 and gripping the rail between the flanged wheel and the gripping hook. The gripping hook is slidably mounted in a bore in guide body 39 and power, i.e. hydraulic, drives 41 and 42 enable gripping hook 40 to be vertially and transversely adjusted with respect to elongated carrier frame 7. For this purpose, the piston rods of hydraulic drive 41 and 42 are affixed to the guide body while the cylinders of the drives are respectively affixed to the gripping hook and to a crossbeam 43 carrying each pair of flanged wheels 8 and gripping hooks 10 and power drives 41, 42 associated therewith. Longitudinally extending guide means 45, i.e. guide rods, longitudinally displaceably mount crossbeam 43 on elongated carrier frame 7. The outer ends of crossbeam 43 define transverse guide 46 wherein guide body 39, with gripping hook 40 and vertical adjustment drive 41, is transversely movably mounted.

As illustrated, the pairs 9 of lifting jacks 13 are arranged immediately adjacent the associated pairs of flanged wheels 8 for hoisting even the heaviest loads without excessive stress on elongated carrier frame 7.

The transverse displaceability of the rail gripping devices by their own power drives enables even the most difficult track sections, such as complex track switches, to be gripped securely. The cooperative arrangement of the flanged wheels with facing gripping hooks facilitates the gripping of the rails and makes double use of the flanged wheels not only as a means for supporting the main vehicle for mobility on the track but also as a counter-bearing for the gripping hooks. The longitudinal displaceability of the gripping hooks along guide means 45 enables the gripping hooks to be positioned between two adjacent ties 2 of track section 4 to subtend the base of rail 3, regardless of the spacing of the ties. Since the flanged wheels are also carried by crossbeam 43, they will be longitudinally moved with the gripping hooks so that they always remain in facing relationship for cooperating in the gripping action.

As also shown in FIG. 3, the cylinder of pivoting drive 20 of bracket 18 carrying off-track undercarriage 16 is mounted on support frame 47 affixed to flatbed frame 19 of auxiliary vehicle 6. In their retracted positions, jacks 33 and 37 do not interfere with the free movement of apparatus 1 along track 26, and jack drives 31, 34 are independently operable from central control panel 11.

FIGS. 4 to 7 illustrate useful modes of operation of mobile apparatus 1 for loading, transporting and laying, for example, a 26 m long track switch. Referring first to FIGS. 4 to 6, track switch 4 to be laid in trackless renewal section 29 between respective ends of railroad track 26 is transported to the renewal section and laid on one end of track 26 immediately adjacent the renewal section. Subsequently, two mobile apparatuses 1 with two main vehicles 5 and two auxiliary vehicles 6 are moved on the track to the track switch which lies on the track, the two main vehicles preceding the auxiliary vehicles in an operating direction indicated by arrow 49. For the movement of the auxiliary vehicles along track 26, off-track undercarriages 16 are pivoted into their retracted rest position so that the auxiliary vehicles are supported on track-bound undercarriages 15 on track 26 whereon they are moved by drive 25. As soon as the two main vehicles have reached track switch 4, they are moved with their flanged wheels 8 onto rails 3 of the track switch by means of small ramps enabling the flanged wheels to move from the rails of track 26 up to the rails of the track switch, the lead main vehicle being stopped in the center of the front half of the track switch and the rear main vehicle being stopped in the center of the rear half of the track switch, as shown in the drawing.

The operator at central control panel 11 of each main vehicle 5 now operates power drives 34 for transversely displacing lifting jacks 13 laterally outside the boundaries of track switch 4 laid on track 26. Subsequently, crossbeam 43 is slightly displaced longitudinally along guide means 45 to position gripping hooks 40 with their associated flanged wheels 44 between adjacent ties 2 of track switch 4. Power drives 41 are then operated to lower gripping hooks 40 and power drives 42 are operated to position the lowered gripping hooks so that they subtend the base of rails 3 of the track switch. This will securely grip the track switch rails between flanged wheels 44 and gripping hooks 40 in a vise-like grip. Drives 31 are now operated to lower support shoes 38 of telescoping lifting jack arrangements 33 onto the track bed and, after shoes 38 have engaged the track bed, to lift the main vehicles with the gripped track switch off the track bed, as shown in FIG. 4. As soon as the distance between the running surfaces of the rails of track 26 and the lower surfaces of ties 2 of track switch 4 exceeds the height of auxiliary vehicles 6, drives 31 are stopped to lock lifting jacks 13 in position. Drives 25 of track-bound undercarriages 15 of auxiliary vehicles 6 are now operated to move the auxiliary vehicles under the lifted track switch, as shown by small arrows 48 in FIG. 4, until they are centered thereunder, as shown in FIG. 5.

After the auxiliary vehicles have been centered under the track switch, drives 31 of lifting jacks 13 are reversed to lower track switch 4 with main vehicles 5 onto support surfaces 14 of flatbed frames 19 of auxiliary vehicles 6. Preferably, inner guide sleeves 32 of the telescoping lifting jack arrangements 33 are completely retracted so that the heavy track switch rests solely on the auxiliary vehicles and there is no possibility of the track switch being caught on a fixed obstacle on the track shoulder. With the track switch resting on the auxiliary vehicles, drives 25 are operated again to move the entire assembly in the direction of arrow 49 towards trackless renewal section 29, as shown in FIG. 5. As soon as front off-track undercarriage 16 projects above the renewal section, pivoting drive 20 is operated to lower the off-track undercarriage onto the track bed and drive 17 of the lowered off-track undercarriage is operated so that the auxiliary vehicle moves on this undercarriage on the track bed in the trackless renewal section. Drive 25 of immediately following track-bound undercarriage 15 is stopped as soon as the flanged wheels of undercarriage 15 no longer engage track 26. As soon as rear undercarriage 15 of front auxiliary vehicle 6 reaches the end of track 26, rear off-track undercarriage 16 is lowered onto the track so that the two track-laying chains 24 of the undercarriage engage the rails of track 26. This assures a secure support of auxiliary vehicle 6 during its transfer from track 26 to renewal section 29 when rear track-bound undercarriage 15 leaves track 26 and enters the renewal section. This same procedure is followed with rear auxiliary vehicle 6 until the track switch has been moved over the trackless renewal section, as shown in FIG. 6, whereupon further movement of the auxiliary vehicles is stopped.

After track switch 4 has been properly centered over trackless renewal section 29, the lifting jacks are lowered again to engage the track bed and then to lift main vehicles 5 with the track switch off loading platform 14 of auxiliary vehicles 6. Since each lifting jack has its own drive, the lifting jacks may be operated individually so that they uniformly and evenly lift the heavy assembly even if the track bed is uneven. As shown by small arrow 50 in FIG. 6, auxiliary vehicles 6 are then moved from the trackless renewal section onto track 26 in the reverse manner as described hereinabove by sequential operation of the successive off-track and track-bound undercarriages: If desired, the auxiliary vehicles may be moved to the same end of track 26 whence they originally came, i.e. in a direction opposite to that indicated by arrow 50.

After auxiliary vehicles 6 have been removed from trackless renewal section 29, drives 31 are reversed to lower track switch 4, with attached main vehicles 5, onto the track bed. If the laying of the track switch in the renewal section requires some alignment of rails 3 of the track switch with the rails of track 26, such minor corrections may be readily effected by transverse displacement of gripping hooks 40 to move the track switch laterally. As soon as the track switch has been laid, power drives 41 and 42 are operated to disengage gripping hooks 40 from rails 3 of the track switch and lifting jacks 13 are retracted. Drives 12 of the track-bound undercarriages are then operated to move main vehicles 5 along rails 3 of the track switch to track 26.

The top view of FIG. 7 illustrates an advantageous handling of heavy, asymmetrical track switch section 51. As shown in the drawing, after being gripped and lifted by main vehicles 5, this heavy track switch may be placed on auxiliary vehicles 6 so that the gravity center line of the track switch is centered with respect to the longitudinal line of symmetry of auxiliary vehicles 6 to avoid any danger of tipping over. Since the auxiliary vehicles are moved in the trackless renewal section on the track bed and not on rails, the track switch may be accurately positioned in the renewal section with respect to the ends of track 26 adjacent thereto. Steering axle 23 of track-laying undercarriages 16 enables these undercarriages to be properly pivoted to move the undercarriages from the renewal section to track 26 so that the flanged wheels of undercarriages 15 may engage the rails of the track.

Mobile apparatus 1 comprising two independently movable vehicles is very economically adaptable to various operating conditions and different lengths of track section. Shorter track sections may be handled by a single apparatus 1 while two or more such apparatuses may be used together for handling longer and/or heavier assembled track sections. The main and auxiliary vehicles may also be used independently of each other, depending on circumstances. For example, main vehicles 5 may remain on track 26 and may be used merely for loading the track switch from the track onto auxiliary vehicles 6. The auxiliary vehicles may then be moved to the renewal site where the track switch loaded on the auxiliary vehicles is unloaded by cranes arranged at the renewal site and is laid by the cranes on the trackless renewal section. The auxiliary vehicles are then returned to main vehicles 5 to receive an additional assembled track section to be moved by auxiliary vehicles 6 to the renewal section. On the other hand, it is also possible to use solely the auxiliary vehicles and to load the assembled track section thereon by cranes for transport to the renewal section where other cranes unload the track section and lay it.

What is claimed is:

1. A mobile apparatus for loading, transporting and laying an assembled track section consisting of rails fastened to ties on a track bed, which comprises (a) a self-propelled main vehicle comprising (1) a carrier frame elongated in the direction of the rails and having two opposite ends spaced from each other in said direction, (2) a pair of transversely aligned flanged wheels at each end of the elongated carrier frame for engagement with, and support on, the rails of the assembled track section, (3) a pair of lifting jacks at each carrier frame end, a respective one of the lifting jacks being associated with a respective one of the flanged wheels, and (4) a respective device mounted on the elongated carrier frame for gripping the track section rails associated with each flanged wheel and associated lifting jack, the lifting jacks being placeable on the track bed and operable to lift the carrier frame and flanged wheels with the assembled track section gripped by the rail gripping devices off the track bed, and (b) an auxiliary self-propelled vehicle movable independently of the main vehicle, the auxiliary vehicle comprising (1) an elongated flatbed frame having two opposite ends spaced from each other in said direction and capable of receiving and supporting the carrier frame and flanged wheels of the main vehicle with the assembled track section gripped by the rail gripping devices, (2) a track-bound undercarriage with flanged wheels and another, off-track undercarriage at each end of the flatbed frame, at least one of the undercarriages at each frame end being retractible, and (3) an independent drive for each one of the undercarriages.

2. The mobile apparatus of claim 1, wherein the elongated carrier frame has a length of at least about 3 m and not exceeding about 15 m to enable assembled track sections with about 5 to 25 ties to be gripped thereto.

3. The mobile apparatus of claim 1, wherein the off-track undercarriages are track-laying undercarriages, and further comprising brackets carrying the track-laying undercarriages, the brackets projecting from the flatbed frame ends and pivoted thereto, and a pivoting drive connected to the track-laying undercarriages for pivoting the same about a horizontal axis extending transversely to the flatbed frame for moving the track-laying undercarriages between an operating position and retracted rest position.

4. The mobile apparatus of claim 3, wherein the brackets are configurated to constitute substantially horizontal extensions of the flatbed frame in the retracted rest position.

5. The mobile apparatus of claim 3, wherein each track-laying undercarriage has two track-laying chains transversely spaced apart a distance corresponding substantially to the transverse spacing of the rails.

6. The mobile apparatus of claim 5, further comprising a substantially vertical steering axle centered between the two track-laying chains and rotatably connecting the track-laying undercarriages to the pivotal brackets.

7. The mobile apparatus of claim 1, further comprising a transverse displacement jack connected to each lifting jack for transversely positioning the lifting jack with respect to the elongated carrier frame.

8. The mobile apparatus of claim 7, wherein the transverse displacement jacks in a retracted position have a length corresponding at least to the length of the ties and comprise power drives for extending them by about a tie length for transverse displacement of the lifting jacks.

9. The mobile apparatus of claim 7, wherein each transverse displacement jack comprises a guiding sleeve of polygonal cross section affixed to the elongated carrier frame and telescopingly housing a transversely movable jack member.

10. The mobile apparatus of claim 9, wherein each lifting jack includes a vertically extending guiding sleeve of polygonal cross section telescopingly housing a longitudinally displaceable inner sleeve of like cross section, each transversely movable jack member being connected to a respective one of the guiding sleeves of the lifting jacks.

11. The mobile apparatus of claim 1, wherein each rail gripping device comprises a respective one of the flanged wheels of the main vehicle, a gripping hook vertically adjustably mounted on the elongated carrier frame and facing the respective flanged wheel for selectively engaging a base or head of the rail and gripping the rail between the flanged wheel and the gripping hook, and power drives for vertically and transversely adjusting the gripping hook.

12. The mobile apparatus of claim 11, further comprising a crossbeam carrying each pair of the flanged wheels of the main vehicle and the gripping hooks and power drives associated therewith, and a longitudinally extending guide means for longitudinally displaceably mounting the crossbeam on the elongated carrier frame.

* * * * *